US006814162B2

(12) United States Patent
Moran et al.

(10) Patent No.: US 6,814,162 B2
(45) Date of Patent: Nov. 9, 2004

(54) ONE CONE BIT WITH INTERCHANGEABLE CUTTING STRUCTURES, A BOX-END CONNECTION, AND INTEGRAL SENSORY DEVICES

(75) Inventors: David P. Moran, The Woodlands, TX (US); George B. Witman, IV, Sugarland, TX (US)

(73) Assignee: Smith International, Inc., Houston, TX (US)

( * ) Notice: Subject to any disclaimer, the term of this patent is extended or adjusted under 35 U.S.C. 154(b) by 62 days.

(21) Appl. No.: 10/215,634

(22) Filed: Aug. 9, 2002

(65) Prior Publication Data

US 2004/0026124 A1 Feb. 12, 2004

(51) Int. Cl.[7] ..... E21B 12/02

(52) U.S. Cl. ..... 175/39; 175/50; 175/41; 324/338; 73/152.05; 250/254

(58) Field of Search ..... 175/40, 50, 41, 175/39; 324/333, 338; 73/152.05; 250/254; 367/35

(56) References Cited

U.S. PATENT DOCUMENTS

| | | | | |
|---|---|---|---|---|
| 3,998,500 A | | 12/1976 | Dixon | 308/8.2 |
| 4,655,300 A | | 4/1987 | Davis, Jr. et al. | 175/39 |
| 4,936,398 A | | 6/1990 | Auty et al. | 175/336 |
| 5,160,925 A | * | 11/1992 | Dailey et al. | 340/853.3 |
| 5,339,036 A | | 8/1994 | Clark et al. | 324/338 |
| 5,475,309 A | * | 12/1995 | Hong et al. | 324/338 |
| 5,501,285 A | | 3/1996 | Lamine et al. | 175/27 |
| 5,519,668 A | * | 5/1996 | Montaron | 367/35 |
| 5,553,678 A | * | 9/1996 | Barr et al. | 175/73 |
| 5,720,355 A | * | 2/1998 | Lamine et al. | 175/27 |
| 5,813,480 A | | 9/1998 | Zaleski, Jr. et al. | 175/40 |
| 6,119,797 A | | 9/2000 | Hong et al. | 175/336 |
| 6,230,822 B1 | | 5/2001 | Sullivan et al. | 175/40 |
| 6,581,699 B1 | * | 6/2003 | Chen et al. | 175/61 |

FOREIGN PATENT DOCUMENTS

| | | | |
|---|---|---|---|
| WO | WO 99/49174 | 9/1999 | E21B/10/22 |

OTHER PUBLICATIONS

Combined Search and Examination Report dated Oct. 9, 2003 (5 pgs).

* cited by examiner

*Primary Examiner*—Roger Schoeppel
(74) *Attorney, Agent, or Firm*—Osha & May L.L.P.

(57) ABSTRACT

A drill bit, comprising a bit body, a sensor disposed in the bit body, a single journal removably mounted to the bit body, and a roller cone rotatably mounted to the single journal.

19 Claims, 14 Drawing Sheets

ONE CONE BIT WITH INTERCHANGEABLE CUTTING STRUCTURES, A BOX-END CONNECTION, AND INTEGRAL SENSORY DEVICES

BACKGROUND OF INVENTION

1. Field of the Invention

The invention relates generally to single roller cone drill bits for drilling boreholes in earth formations. More specifically, the invention relates to a single cone bit with interchangeable cutting structures, a box-end connection, and integral sensory devices for evaluation of the formation and bit health.

2. Background Art

One aspect of drilling technology relates to roller cone drill bits are used to drill boreholes in earth formations. The most common type of roller cone drill bit is a three-cone bit, with three roller cones attached at the end of the drill bit. When drilling smaller boreholes with smaller bits, the radial bearings in three-cone drill bits become too small to support the weight on the bit that is required to attain the desired rate of penetration. In those cases, a single cone drill bit is desirable. A single cone drill bit has a larger roller cone than the roller cones on a similarly sized three cone bit. As a result, a single cone bit has bearings that are significantly larger that those on a three cone bit with the same drill diameter.

FIG. 1A shows a prior art single cone drill bit. The single cone bit 1 includes one roller cone 4 rotatably attached to a bit body 16 such that the cone's drill diameter is concentric with the axis of rotation 6 of the bit 1. The roller cone 4 has a hemispherical shape and typically drills out a bowl shaped bottom hole geometry. The drill bit 1 includes a threaded connection 14 that enables the drill bit 1 to be connected to a drill string (not shown). The male connection shown in FIG. 1A is also called a "pin" connection. A typical single cone bit is disclosed in U.S. Pat. No. 6,167,975, issued to Estes.

FIG. 1B shows a cross section of a prior art drill bit 1 drilling a bore hole 3 in an earth formation 2. The roller cone 4 is rotatably mounted on a journal 5 that is connected to the bit body 16.

Another aspect of drilling technology involves formation evaluation using sensors that detect the properties of the formation, such as resistivity, porosity, and bulk density. Formation evaluation allows a well operator to know the properties of the formation at various depths so that the well can be developed in the most economical way. Three of the sensors known in the art that are used for formation include button resistivity sensors, density logging sensors, and neutron logging sensors, each of which will now be described.

A button resistivity tool includes a number of electrode buttons, for example three buttons, that are placed into contact with the borehole wall. One of the buttons injects an electrical current into the formation, and the potential difference is measured between the other two buttons. The potential difference is related to the resistivity of the formation. Button resistivity tools are described with more detail below in the discussion of measurement-while-drilling applications.

A density logging tool uses back scattered radiation to determine the density of a formation. A typical density logging tool is described in U.S. Pat. No. 4,048,495, issued to Ellis, and is shown in FIG. 2. The density logging tool 20 is shown disposed in a borehole 3 on a wireline 10. The tool 20 includes a caliper 5 that positions the tool 20 so that the source 24 and sensors 21, 22 of the tool 20 are pressed into the mud-cake layer 23, as close as possible to the borehole wall 12.

The density logging tool 20 contains a gamma ray source 24, typically Cesium-137, that emits medium energy gamma rays into the formation. The source 24 is enclosed in shielding 26 that shields the detectors 21, 22 from gamma rays coming directly from the source 24. The front face 29 of the tool includes a window 25 that enables a collimated beam of gamma rays to be transmitted into the formation 2. Through a process called "Compton scattering," the gamma rays scatter back into the borehole and into the detectors 21, 22.

Compton scattering is the interaction of a gamma ray with electrons. When a gamma ray interacts with an electron, it imparts part of its energy to the electron, and the gamma ray changes direction. Through one or more Compton scattering events, gamma rays can be scattered back into the borehole. The number of scattering events that occur depends on the density of electrons in the material into which the gamma rays are transmitted. Because the density of electrons depends on the density of the material, a density logging tool can measure the density of a formation by measuring the number of gamma rays that are back scattered in the formation and return to the borehole where they can be detected by the tool.

A typical density logging tool 20 contains two gamma ray detectors, a short-spaced detector 22, and a long-spaced detector 21. The long-spaced detector 21 is located about 36 cm from the source 24. Because of the distance between the source and the long-spaced detector 21, the long-spaced detector receives gamma rays that are mostly scattered deep in the formation 2. Further, the front face 27 of the density tool has a window 28 over the long-spaced detector 21. The window 28 is shaped to collimate the gamma rays so that those gamma rays that are received in the detector 21 are even more likely to have scattered relatively deep in the formation 2 and not the mud-cake layer 23. Even with the location of the long-spaced detector 21 and the collimating window 28, the density computed by the long-spaced detector 21 is still affected by the density of the mud-cake layer 23, which the gamma rays must pass through twice. Thus, the density value computed from the long-spaced detector 21 is strongly affected by the density of the mud-cake layer 23.

The density measured by the long-spaced detector 21 can be corrected using the short-spaced detector 22, which is typically located about 11 cm from the source. The short-spaced detector 22 receives back scattered gamma rays that have scattered in materials close to the borehole wall 3, like the mud-cake layer 23. Again, a window 29 in the front face 27 of the tool 20 collimates the incoming gamma rays so as to increase the chance that detected gamma rays were scattered in the mud-cake layer 23. By combining the measurements of the two detectors 21 and 22, a corrected value for the formation density can be computed, as is known in the art.

A neutron logging tool makes a measurement corresponding to the porosity of a formation. A typical neutron logging tool is disclosed in U.S. Pat. No. 4,035,639 issued to Boutemy et al. A neutron logging tool contains a neutron source, typically an Americium-Beryllium source, and a neutron detector. The source emits high energy neutrons, also called "fast" neutrons, into the formation. The fast neutrons lose energy as they collide with atoms in the formation, eventually becoming slow neutrons, also called "thermal" neutrons. Thermal neutrons will randomly migrate in the formation. Some of the migrating thermal neutrons will migrate back into the borehole. A neutron logging tool detects the thermal neutrons that randomly migrate back into the borehole.

Hydrogen atoms, with an atomic number of one, have approximately the same mass as a neutron. Because of their similar mass, a neutron loses much more energy in collisions with hydrogen atoms than it does in collisions with any other atom. Thus, the rate at which fast neutrons become thermal is related to the number of hydrogen atoms in the moderating material. As a result, the number of thermal neutrons detected by the neutron logging tool is related to the number of hydrogen atoms in the formation. Because water and hydrocarbons have a similar amount of hydrogen atoms, the neutron logging tool measures how much of the formation is occupied by water and hydrocarbons. In non-gas bearing formations, a measurement from a neutron logging tool is related to the formation's porosity.

FIG. 3 shows a wireline neutron logging tool 30. A source 31 is located in the tool 30 surrounded by shielding 32. The example neutron logging tool 30 in FIG. 3 shows two detectors, 33 and 34, that are used to detect thermal neutrons and ultimately to calculate the formation porosity. The two detectors 33, 34 are spaced apart on the neutron logging tool 30. Using the known spacing of the detectors, a ratio of the count rates can be used to correct the porosity calculation for borehole shape effects.

The neutron logging tool 30 also includes a caliper 35 that serves two purposes. First, it pushes the source 32 and sensors 33, 34 into the opposite face 12 of the formation 2. Second, the distance that the caliper 35 extends to the wall 36 can be added to the tool size to compute the borehole diameter, which affects the neutron measurement.

To improve on the formation evaluation by wireline tools, well logging tools can be disposed on a drill string and measurements can be made while drilling. Such measurements are called measurement-while-drilling ("MWD"), or logging-while-drilling ("LWD"). In MWD, sensors are disposed on the drill string and used for formation evaluation during drilling operations. MWD enables formation evaluation before the drilling fluid ("mud") invades the drilled formation and before a mud-cake layer is formed on the borehole wall.

FIG. 4 shows a prior art drilling system with an MWD tool 42, as disclosed in U.S. Pat. No. 5,339,036 issued to Clark et al. A drilling rig 40 is positioned over a bore hole 3 that is drilled into an earth formation 2. Typically, sensors are located in subs 41 that are positioned a few feet above the drill bit 43 on the drill string 44. In that position, the sensors can evaluate the formation 2 before significant invasion of the formation by the drilling fluid takes place.

Drilling fluid 45 is pumped down through the drill string 44 and ejected through ports in the drill bit 43. The drilling fluid 45 is used to lubricated the drill bit 43 and to carry away formation cuttings, but it also can interfere with formation evaluation. Because of the hydrostatic pressure of the drilling fluid 45 at the drilling depth, the drilling fluid 45 seeps into the formation 2. This process is called invasion. Sensors on a wireline tool (as shown in FIGS. 2 and 3) can be moved through the borehole only after drilling is stopped and the drill bit and drill string have been removed from the borehole. Often, the drilling fluid is pumped out of the borehole before a wireline tool is used. Wireline tools are often affected by the properties of the drilling fluid 45 that has invaded the formation 2. By disposing sensors in a sub or MWD collar 41 and performing formation evaluation while drilling, the measurements can be made before there is significant invasion, thereby enabling more accurate measurements.

FIG. 5 shows a cross-section of a MWD collar 50 on a drill string 44. The collar 50 surrounds the drill pipe 44. A button resistivity tool is disposed in the drill collar 50. Three button electrodes 53, 54 and 55 are shown on a blade 56 that extends radially from the collar 51. The blade 56 places the electrodes 53, 54, and 55 in contact with a borehole wall (not shown in FIG. 5), enabling accurate formation evaluation. One of the electrodes injects a electrical current into the formation, while the other two electrodes measure the potential difference between them. The measured potential difference and the distance between the two measuring electrodes are related to the formation resistivity.

By way of example only, electrode 53 in FIG. 5 could be used as the injecting electrode. Electrodes 54 and 55 would measure the potential difference that exists between them.

Even using MWD, however, there is still some invasion of the mud filtrate into the formation that causes errors in the measurements. Because the drilling fluid is pumped through ports in the drill bit, the formation is exposed to the drilling fluid for the time it takes the drill to penetrate the distance between the bit and the MWD collar. Many of these errors can be avoided if the sensors are disposed in the drill bit itself, thereby enabling the formation to be evaluated at, and even ahead of, the point where drilling is occurring.

One example of a drill bit with integral sensors is disclosed U.S. Pat. No. 5,475,309 to Hong et al. FIG. 6A shows a drill bit 61 with an integral sensor 60. Sensor 60 is a dielectric tool that measures the water content of the formation near the drill bit. The sensor 60 can evaluate the formation 2 at the drilling depth 62, before the formation 2 is penetrated by the bit 60. A sensor 60 disposed in the drill bit enables more accurate measurements because the formation is evaluated before any significant invasion of drilling fluid into the formation 2.

Another drill bit with integral sensors is shown in FIG. 6B, as disclosed in U.S. Pat. No. 5,813,480 issued to Zaleski, Jr., et al. FIG. 6B shows a three cone drill bit 68 with temperature sensors 65 located in the journal 67. The temperature sensors 65 transmit data to a telemetry or data storage system by way of a wire 68 that runs through the journal 65 and the bit body 66. If the temperature in the journal begins to rise and exceed normal operating conditions, that is a signal that the journal bearings are beginning to fail. Corrective steps, like replacing the drill bit, can be taken before a catastrophic failure occurs.

SUMMARY OF INVENTION

One aspect of the invention relates to a drill bit with a bit body adapted to be coupled to a drill string. The bit body also has a sensor disposed therein. A single journal is removably mounted to the bit body, and a roller cone is rotatably mounted to the journal. In some embodiments, the bit body also includes a box-end connection.

Another aspect of the invention relates to a bit body comprising a box-end connection on one end of the bit body and a journal connection on an opposite end from the box-end connection, the journal connection adapted to receive a removably mounted journal. The bit body includes a sensor mounted therein.

Yet another aspect of the invention relates to a drill bit comprising a bit body adapted to be coupled to a drill string, a single journal removably mounted to the bit body, a temperature sensor disposed in the single journal, and a roller cone rotatably mounted on the single journal. In some embodiments, the drill bit includes a sensor disposed in the bit body.

Another aspect of the invention relates to a drill bit comprising a bit body, at least one sensor disposed in the bit body, a short-hop telemetry transmitter disposed in the bit body, and a box end connection adapted to connect the drill bit to a rotary steerable system. The drill bit in this aspect of the invention also includes a single journal removably mounted to the bit body and a roller cone rotatably mounted on the journal.

Yet another aspect on the invention relates to a drill bit comprising a bit body, a box-end connection adapted to connect the drill bit to a drill string, and a sensor disposed in the bit body.

Other aspects and advantages of the invention will be apparent from the following description and the appended claims.

DETAILED DESCRIPTION

Figure 7:
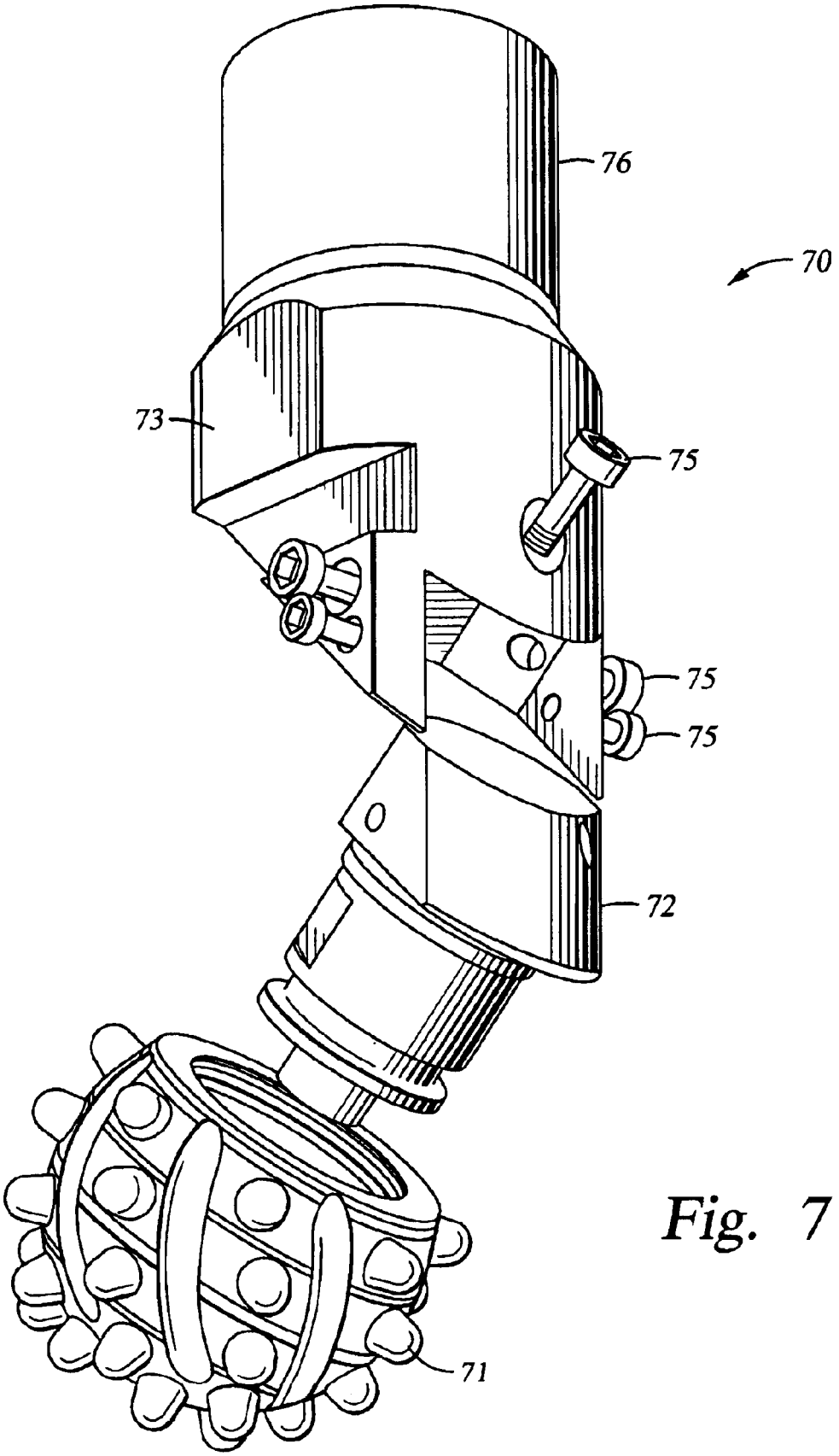
FIG. 7 shows an exploded view of a bit body, a removable journal, and a roller cone according to one embodiment of the invention.

FIG. 7 shows an exploded view of one embodiment of the invention. A removable journal 72 is attached at a lower end of the bit body 73 with bolts 75. A single roller cone 71 can be rotatably mounted on the journal 73. A complete drill bit 70 is formed by the bit body 73, the removable journal 72 attached to the bit body 73, and a roller cone 71 rotatably mounted on the journal 72.

In this disclosure, "rotatably mounted" in intended to indicate that the roller cone is fixed on the journal, but in such a way that it is able to freely rotate.

The removable journal 72 can be attached to the bit body 73 by any suitable means. FIG. 7 shows bolts 75 that fasten the journal 72 in place, although one having skill in the art could devise other suitable ways to attach a removable journal without departing from the scope of this invention. The invention is not intended to be limited by the method of journal attachment.

The bit body 71 in this embodiment is reusable and can include various sensors therein, as will be explained below with reference to FIGS. 8A, 8B, 8C, and 8D. Advantageously, the reusable bit body 73, and any sensors mounted therein, can be used with more than one roller cone. Even when the roller cone 71 experiences failure or wears to the point that it must be replaced, the bit body 73, and any sensors mounted therein, can be reused by removing the journal 72 and the roller cone 71 and attaching a new journal and roller cone. The reusable bit body 73 provides for an economical deployment of sensors, because the bit body 73 and any sensors mounted therein can be used with a plurality of different drill cones. This deployment of the sensors saves the cost of having to replace the bit body having sensors still well within their life cycle, because the roller cone of bearing journal has worn out or failed.

Figure 1:
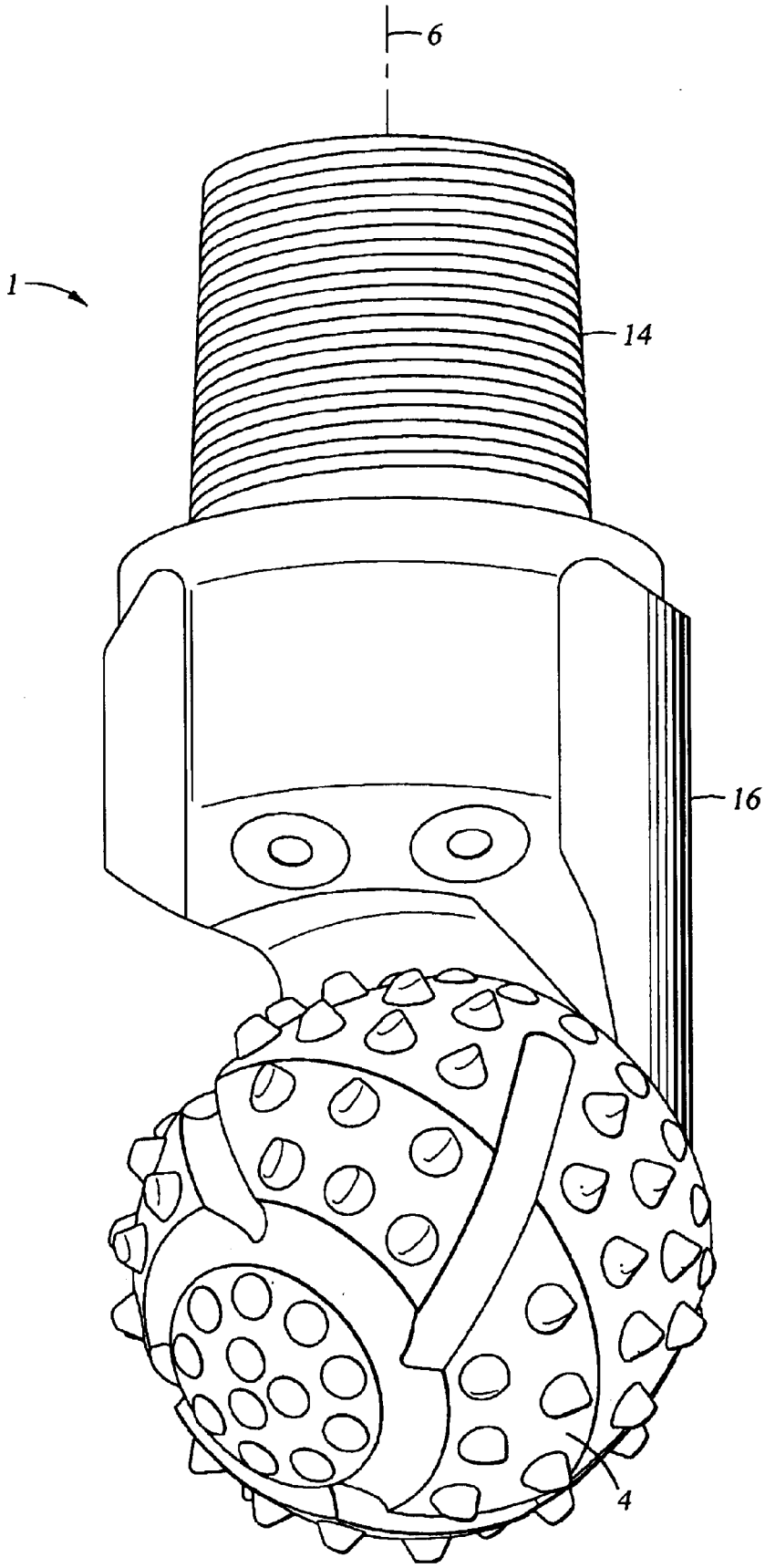
Fig. 1 (PRIOR ART)
FIG. 1A shows a prior art single cone drill bit.
FIG. 1B shows a cross section of a prior art single cone drill bit.
Figure 1B:
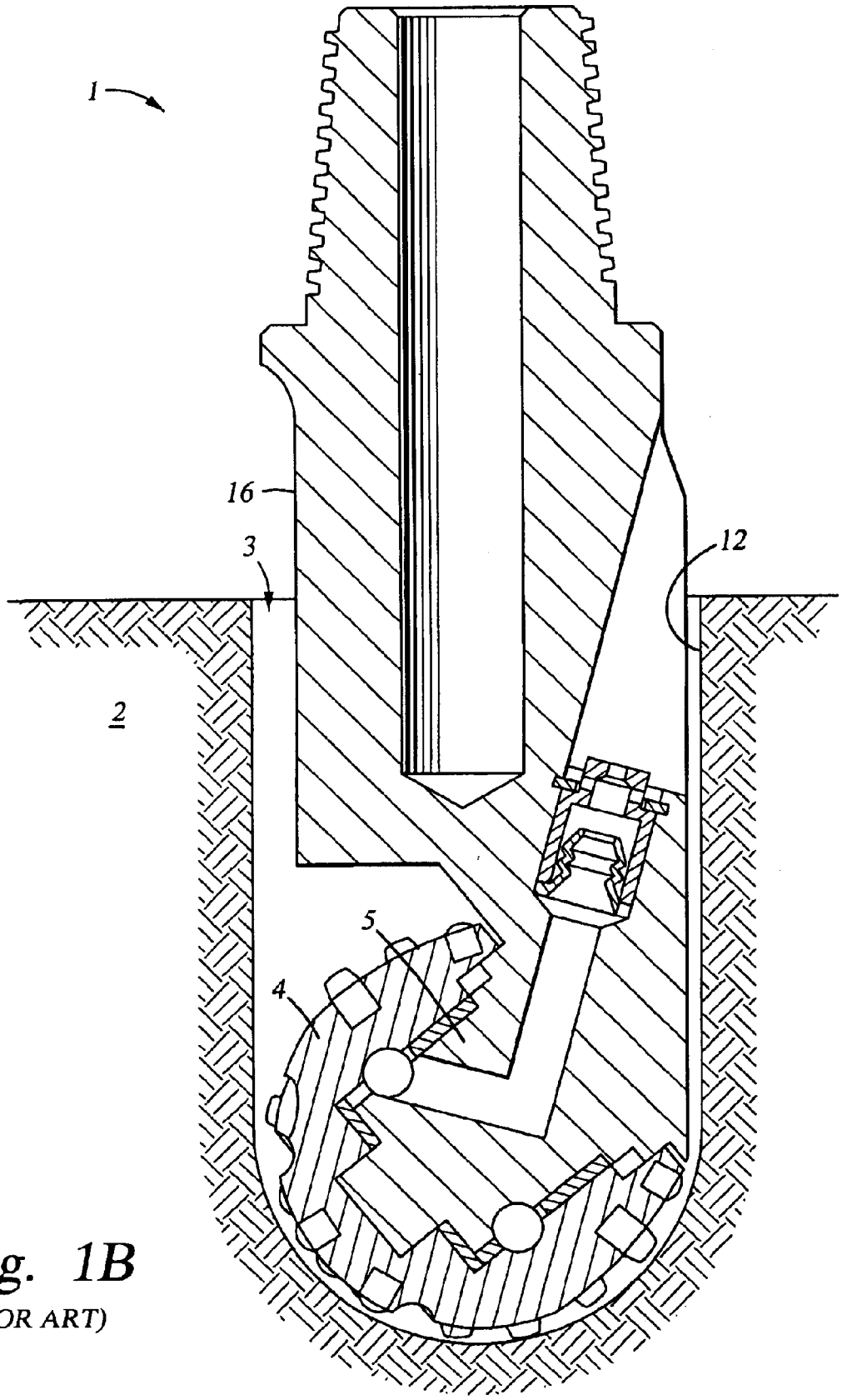
Fig. 1B (PRIOR ART)
Figure 2:
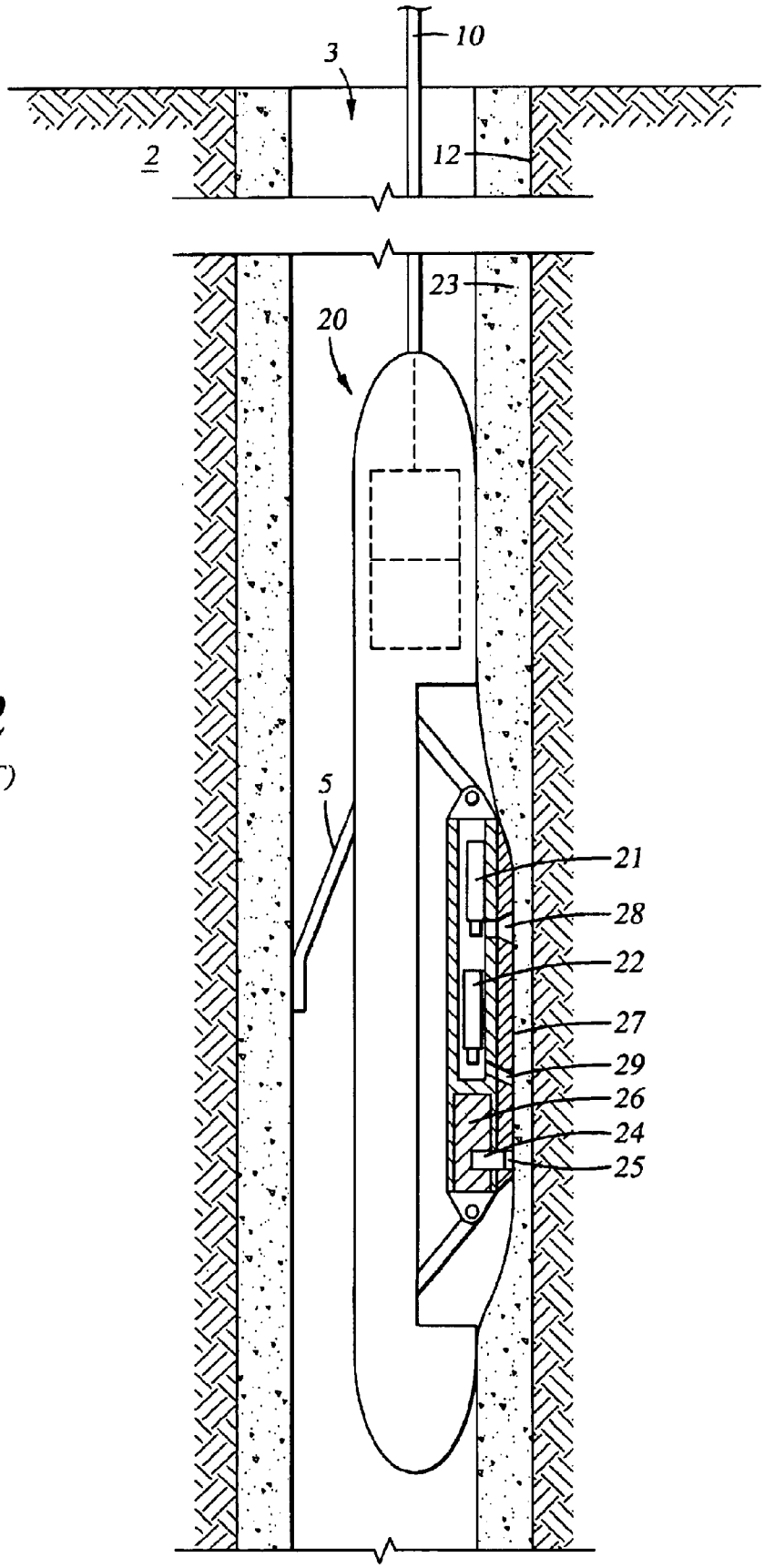
Fig. 2 (PRIOR ART)
FIG. 2 shows a cross section of a prior art density logging tool.
Figure 3:
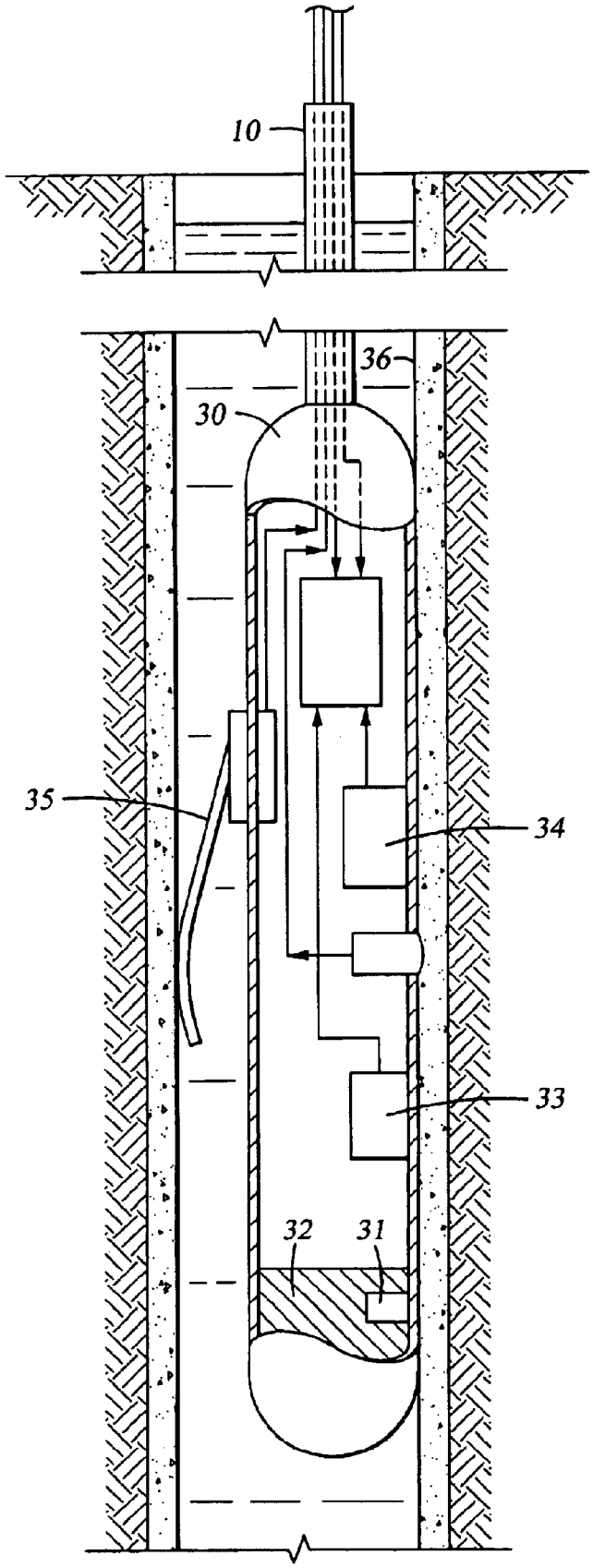
Fig. 3 (PRIOR ART)
FIG. 3 shows a cross section of a prior art neutron logging tool.
Figure 4:
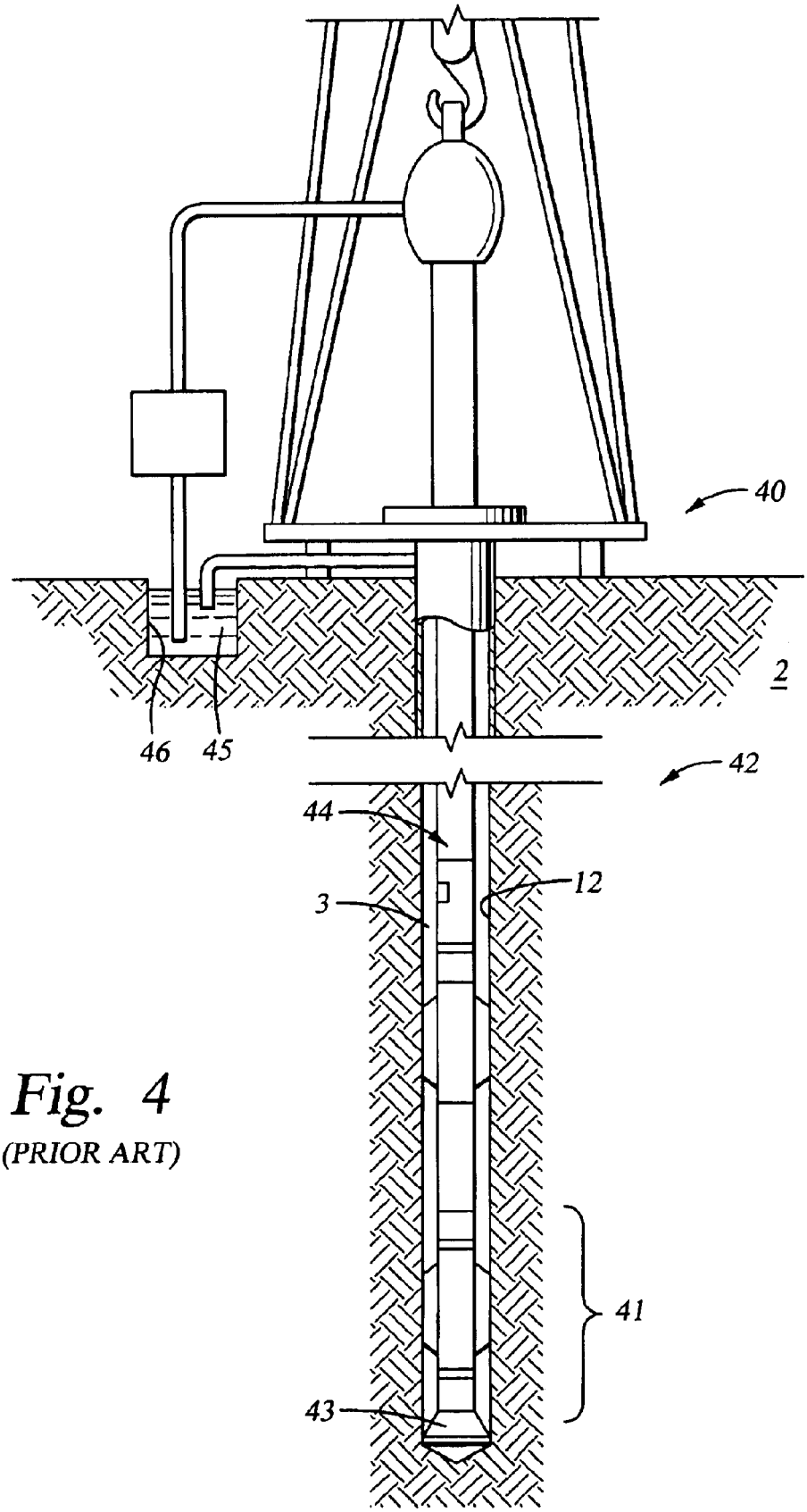
Fig. 4 (PRIOR ART)
FIG. 4 shows a cross section of a prior art drilling system with a measurement-while-drilling tool.
Figure 5:
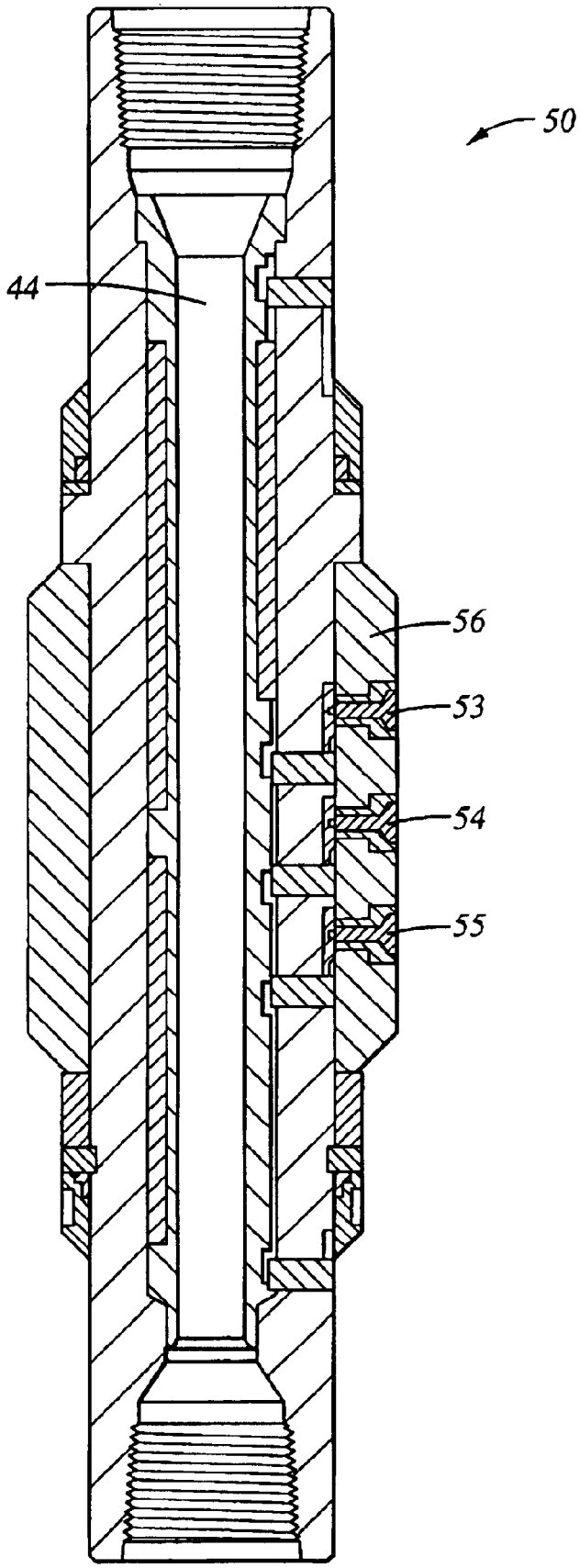
Fig. 5 (PRIOR ART)
FIG. 5 shows a cross section of a prior art measurement-while-drilling resistivity tool.

Another element of a bit in accordance with one aspect of the invention, also shown in FIG. 7, includes a reusable bit body 73 with a box end connection 76. Instead of the typical male threaded connection at the upper end of the bit body (shown at element 14 in FIG. 1), the bit body 73 according to this aspect of the invention has a female box-end connection 76. That is, the lower end of the drill string has a connection (not shown) that is threaded into the bit body 73. The box-end connection 76 is located on the bit body 73 on the end opposite from the removable journal 72.

Figure 8A:
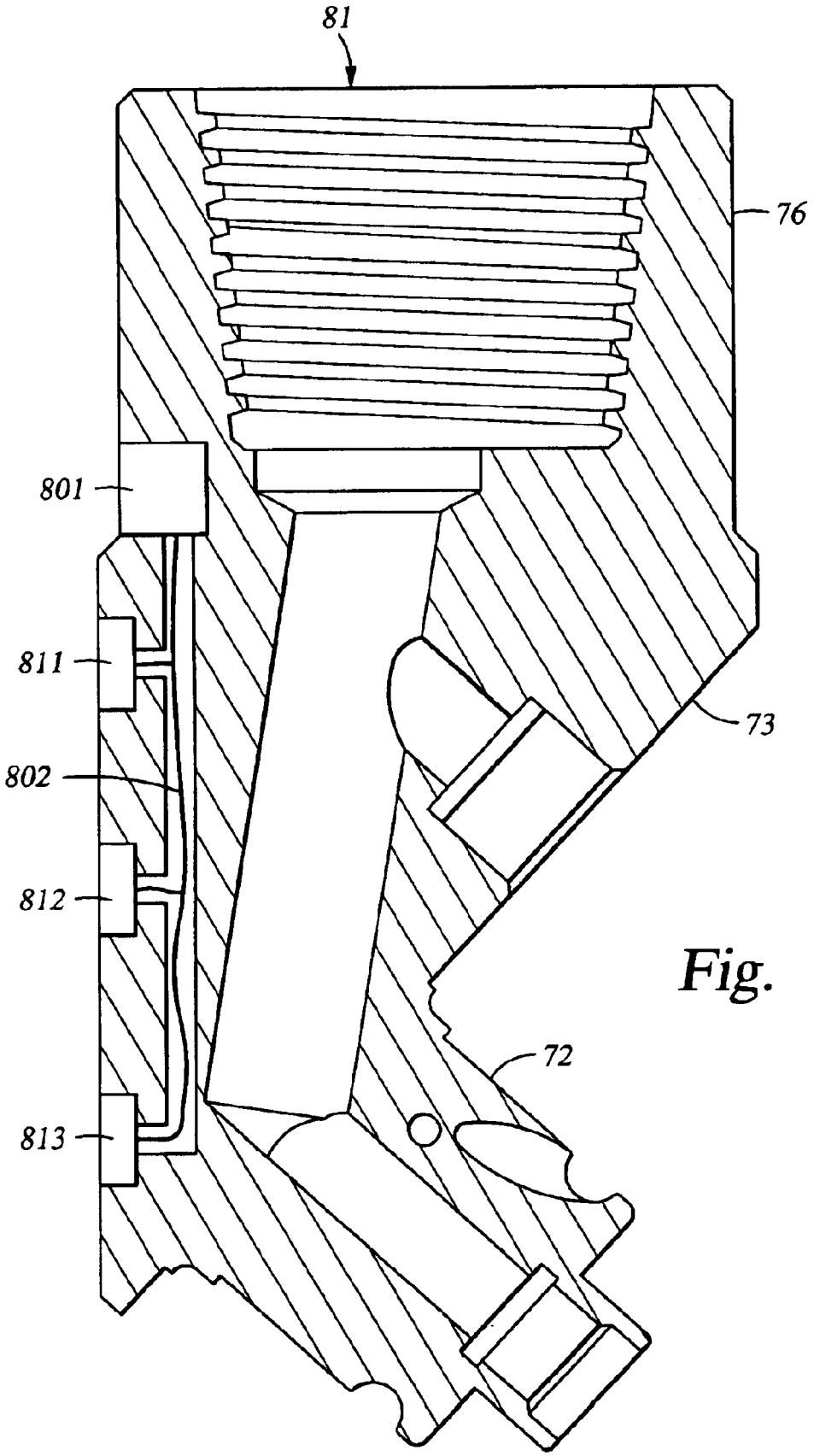
FIG. 8A shows a cross section of one embodiment of a drill bit according to the invention, having a resistivity sensor mounted in the bit body.

FIG. 8A shows the box-end connection 76 in a cross section view. A threaded connection on the drill string (not shown) is inserted into the box-end 76 of the bit body 73 at 81. FIGS. 8A–8D also show a mud channel located in the bit body 73 that delivers drilling fluid from the drill string, through the bit body 73, through the journal 72, so the drilling fluid can be discharged near the roller cone (not shown in FIGS. 8A–8D).

Advantageously, the box-end connection 76 according to this aspect of the invention provides for more space in the bit body 73 to locate additional sensors. The added space gained with a box-end connection also enables the bit body to be adapted to house measurement devices that require spacing of sensor components for proper operation. Such devices include the density and neutron devices described on the foregoing Background section, where the sensor components require spacing from a source for proper operation and depth of investigation.

Figure 6A:
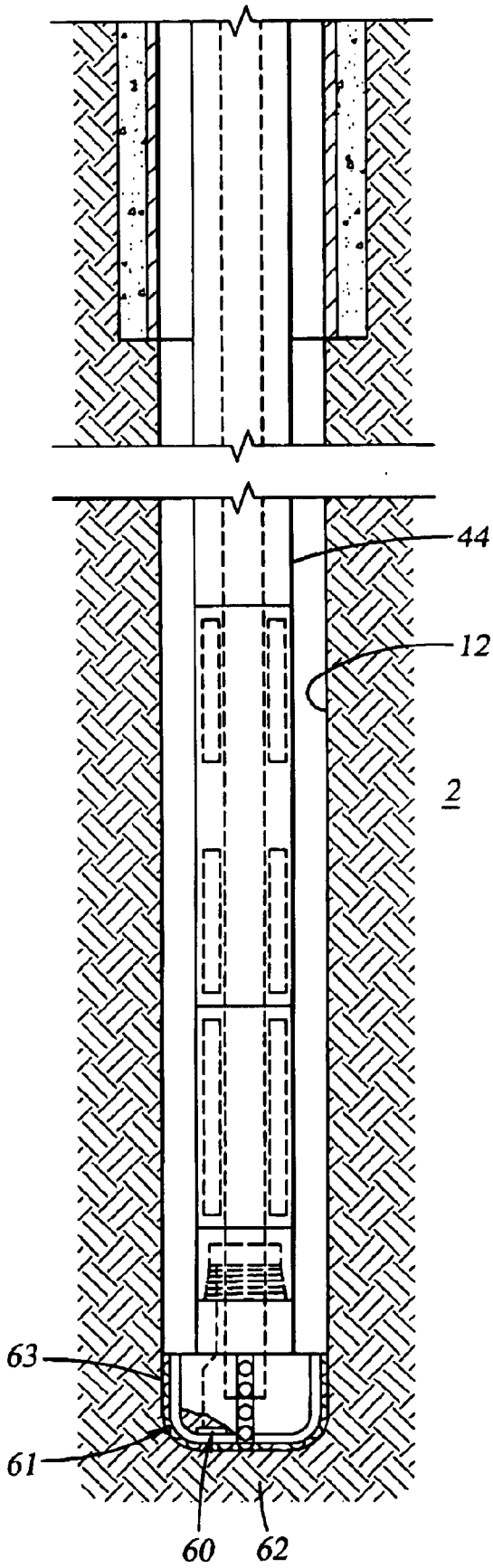
Fig. 6A (PRIOR ART)
FIG. 6A shows a cross section of a prior art drill bit with an integral sensor.
Figure 6B:
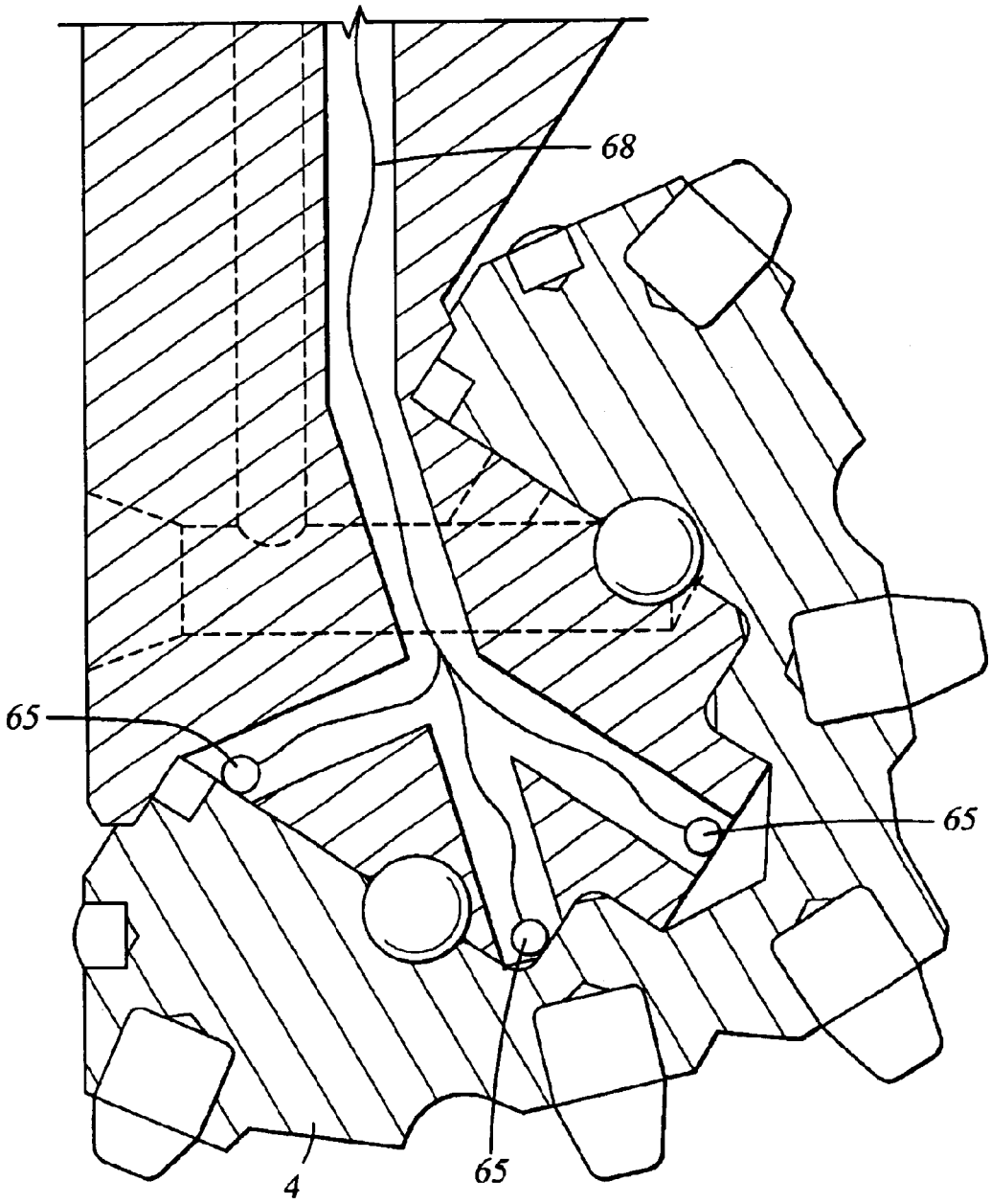
Fig. 6B (PRIOR ART)
FIG. 6B shows a cross section of a prior art roller cone with integral temperature sensors.

FIG. 8A shows another aspect of the invention, wherein the bit body 73 includes sensors used for MWD. Resistivity buttons 811, 812, and 813 are disposed in bit body to measure the resistivity of a formation. The resistivity buttons can operate the same as those disclosed in U.S. Pat. No. 5,339,036 issued to Clark et al., as described in the foregoing Background section. Advantageously, the single roller cone bit body allows the resistivity buttons mounted therein to be in contact with the borehole wall, where, as can be seen in FIG. 6B, the shirttail 66 of a three cone bit trails away from the borehole wall.

Here, in FIG. 8A, the buttons 811, 812, and 813 are connected, via a wire 802, to a short-hop telemetry device 801. The short-hop telemetry device 801 is located in the bit body 73. It receives signals corresponding to the resistivity measured between the buttons 811, 812, and 813 and transmits the signals via a radio frequency to a telemetry or a receiver having a data storage unit located further up on the drill string.

The short-hop telemetry device 801 shown in FIG. 8A may be any of a number of devices known in the art. For example, the drill bit could include a data storage device, which stores the measurement until the tool is removed from the hole, instead of a short-hop telemetry device. Further, a data analysis device may be used. A data storage, analysis, or telemetry system will be described below in the section regarding rotary steerable systems and MWD collars.

Figure 8B:
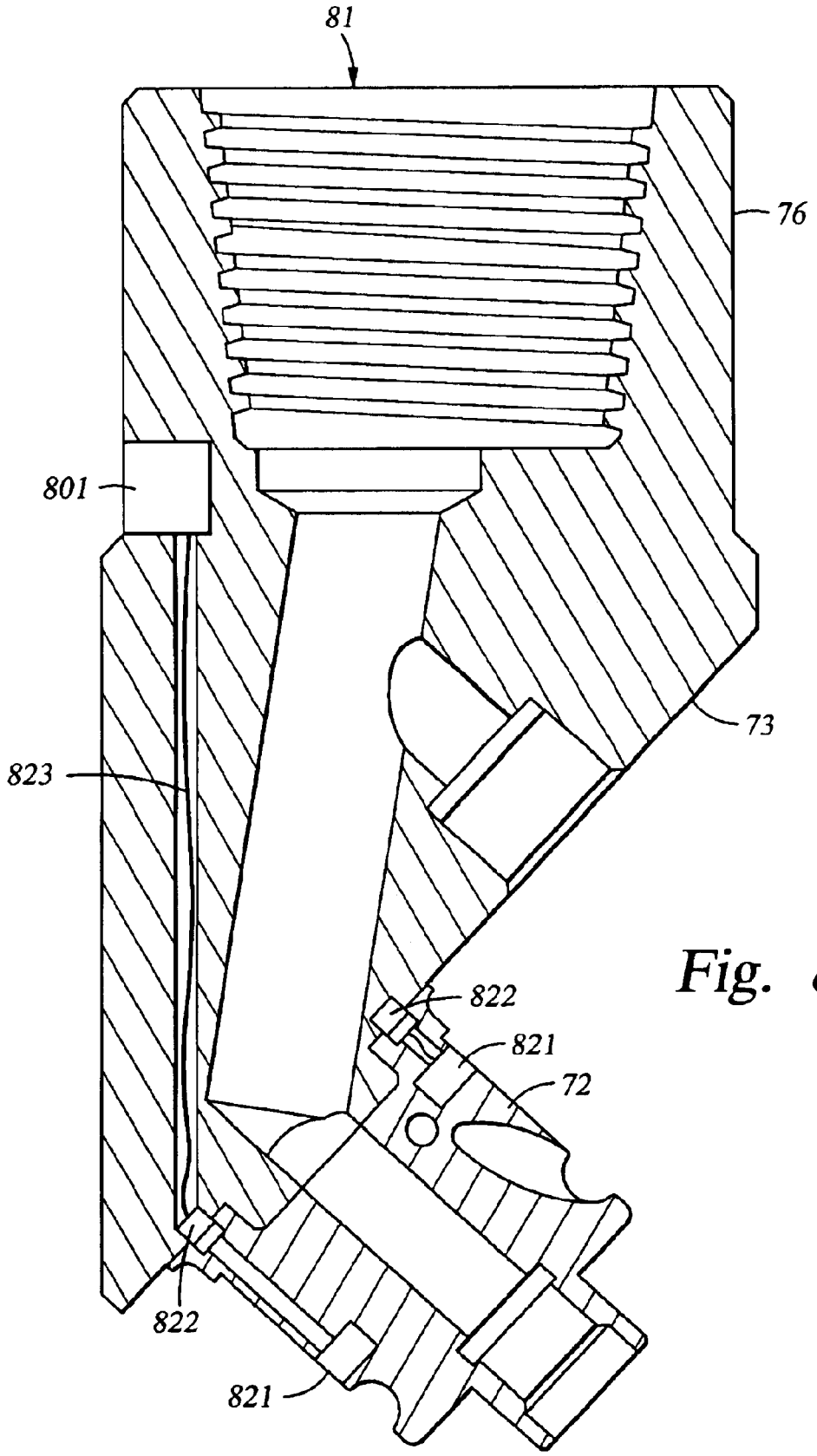
FIG. 8B shows a cross section of one embodiment of a drill bit according to the invention, having a temperature sensor mounted in the journal

FIG. 8B shows a cross section of yet another embodiment of the invention. The removable journal includes temperature sensors 821. The temperature sensors 821 monitor the temperature of the journal for temperature spikes that might indicate a bearing failure. In this embodiment, the bit body 73 has a connector 822 that is adapted to connect with wires 823 in the removable journal 72. The connector 822 is in turn connected to the short-hop telemetry device 801, where the temperature data is transmitted to a data analysis or storage collar or a telemetry collar.

Figure 8C:
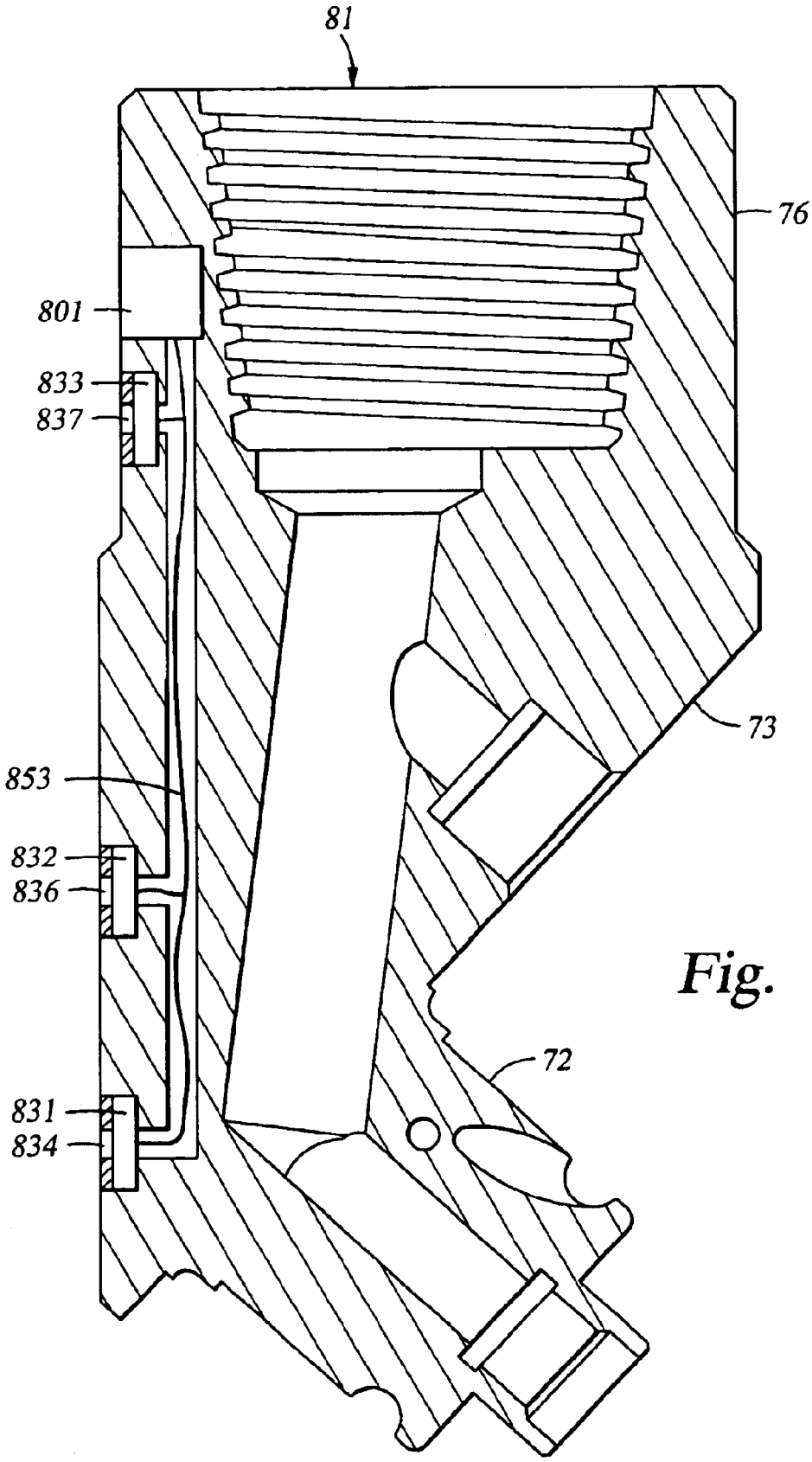
FIG. 8C shows a cross section of one embodiment of a drill bit according to the invention, having a density logging sensor mounted in the bit body.

FIG. 8C shows a cross section of one embodiment of the invention where the bit body 73 includes an integral density logging sensor. The bit body 73 includes a gamma ray source 831. The bit body itself is used to shield the detectors 832, 833 from any direct gamma rays, and has a hole 834 to collimate the gamma rays that are transmitted into the formation 2. A short-spaced detector 832 is located in the bit body 73, above the source 831. The long-spaced detector 833 is shown located much higher in the bit body 73. The box-end connection 76 enables the long-spaced detector 833 to be located farther away from the source than it could be in a typical threaded pin bit. The box-end connection 76 enables the long-spaced detector 833 to receive gamma rays scattered mostly in the formation. The bit body 73 also includes collimating holes 836 and 837 that collimate the gamma rays received in the short and long spaced detectors 832 and 833, respectively. The collimating hole 836 in front of the short-spaced detector 832 increases the probability that gamma rays received in the short-spaced detector were scattered in the mud-cake layer 23. Similarly, collimating hole 837 ensures gamma rays received in the long-spaced detector 833 were scattered deep in the formation 2. The source and the detectors can be connected with wires 853. Advantageously, the box-end connection enables a bit-body with enough space to house short and long spaced detectors for a density logging sensor.

Figure 8D:
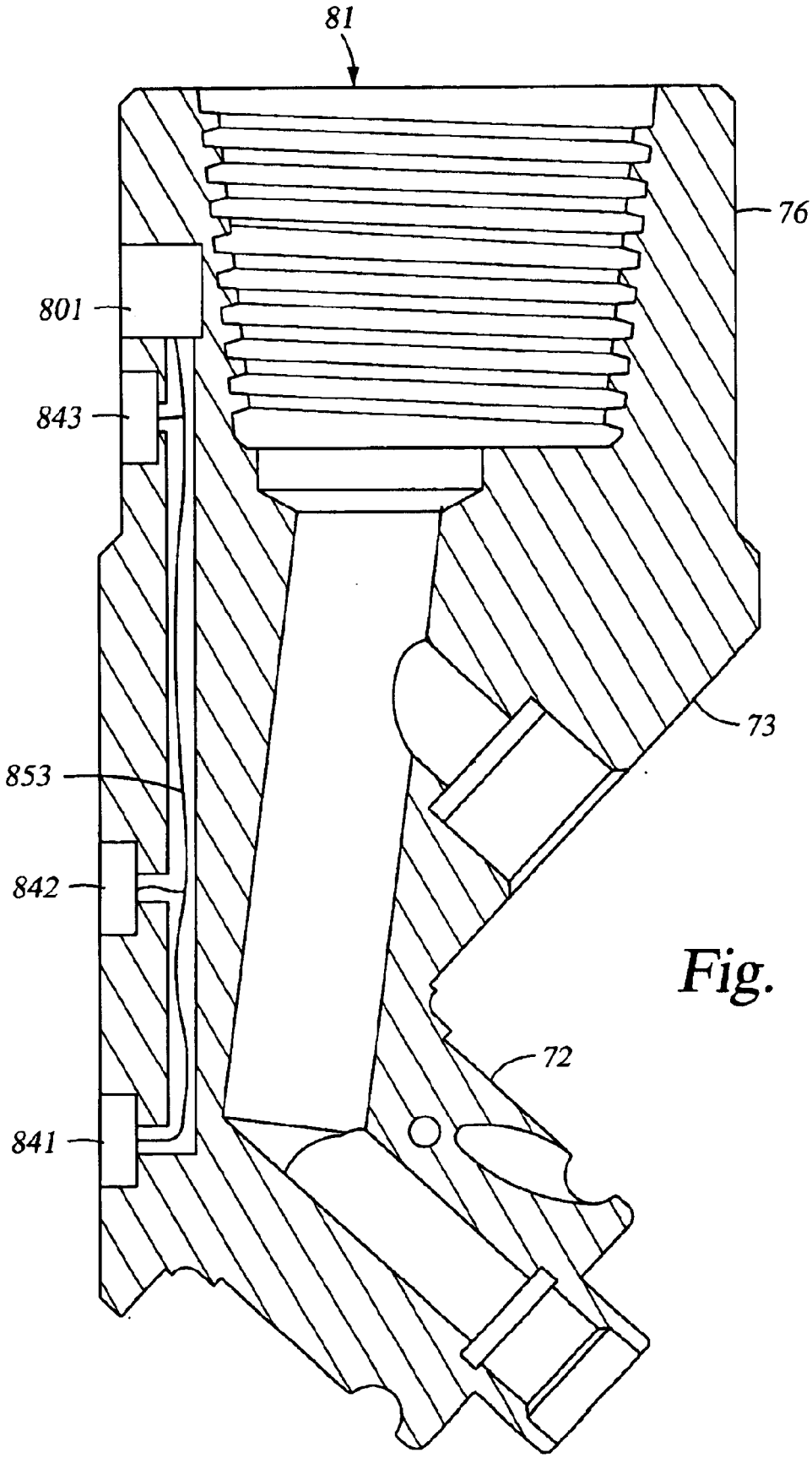
FIG. 8D shows a cross section of one embodiment of a drill bit according to the invention, having a neutron logging sensor mounted in the bit body.

FIG. 8D shows a cross section of one embodiment of the invention where the bit body 73 includes an integral neutron logging sensor. A neutron source 841 is located in the bit body 73, the material of the bit body 73 acts to shield the neutron detectors 842, 843 from the source 841. One of the neutron detectors 842 is located in the bit body 73 above the source 841. The second detector 843 can be located in the box-end connection 76, with enough separation from the first detector 842 so that the count rates will provide an accurate measurement. The source and the detectors can be connected with wires 853. Advantageously, the box-end connection provides the bit-body with enough axial space to house two neutron detectors.

Those having skill in the art will realize that other sensors can be included in the drill bit without departing from the scope of the invention. The sensors illustrated in this disclosure may be of particular use in a drill bit, but the invention is not intended to be limited by the type of sensor. Further, the invention is not limited to a drill bit with only one sensor. For example, the journal temperature sensors could be combined in the same drill bit body with a neutron sensor or a density sensor. Those having skill in the art will be able to devise other combinations of sensors to be used in a drill bit, without departing from the scope if the invention.

Figure 9:
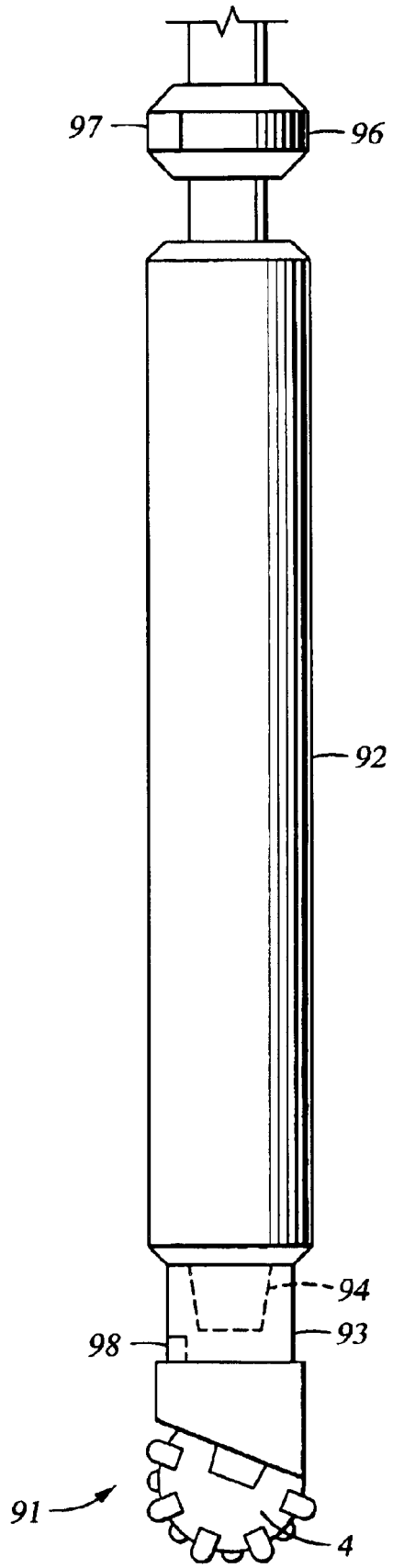
FIG. 9 shows a perspective view of a drill bit in accordance with one embodiment of the invention on a drill string with a rotary steerable system and a measurement-while-drilling collar.

Referring to FIG. 9, the box-end connection 93 used in one or more embodiments of the invention also enables the drill bit 91 to be mounted closer to a rotary steerable system ("RSS") 92 than a male threaded (pin) connection would allow. A typical RSS device includes a looking down pin connection. When both the RSS and the drill bit have a pin connection, a cross-over sub is required to connect the RSS and the drill bit. A drill bit with a box-end connection enables the drill bit to be connected to the RSS without a cross-over sub.

The drill string 95 is connected to an RSS 92. The drill string 44 and the RSS 92 are connected to the drill bit 91 by a threaded connection 94 on the drill string that is inserted into the box-end connection 93 on the bit body.

An RSS device allows an operator to change the direction of the drill bit, or steer the drill bit, during drilling. By steering a drill bit, an operator can avoid obstacles, direct the drill bit to the desired target reservoir, and drill a horizontal borehole through a reservoir to maximize the length of the borehole penetrating the reservoir.

Advantageously, when the drill bit 91 is located closer to the RSS 92, the torque and vibration created by the RSS 92 are reduced. This enables the RSS 92 and the drill bit 91 to have longer operating lives. Further, the reduced torque and vibrations enables the operator to have better directional control of the RSS 92 and the drill bit 91, resulting in a more accurate well path to the desired target.

The combination of sensors mounted in the drill bit and a bit body with a box-end connection also has advantages. When sensors are located in the drill bit, they do not have to be located in a MWD collar above the drill bit. Typically, the MWD collar would be located behind the drill bit and the RSS, thereby increasing the distance between the drill bit and the MWD collar. Because the sensors can be mounted in the drill bit having a box-end connection, measurements are made at the drilling face, thereby eliminating some of the interference from the drilling fluid.

The advantages of the box-end connection can be gained by connecting the drill bit with other downhole devices. For example, it is known in the art to locate drive devices above the drill bit. Drive devices, such as a positive displacement motor or a mud turbine, convert the pressure of the drilling fluid into mechanical rotation. A box-end connection enables the drill bit to be located closer to such drive devices than with a pin connection. Advantageously, the vibrations and stresses associated with transmitting rotational motion to the drill bit are reduced when the drill bit is located closer to the drive device.

FIG. 9 also shows an MWD collar 96 located above the RSS 92 on the drill string 44. The MWD collar 96 in this location has a short-hop telemetry receiver 97 used to receive short-hop data transmissions from the short-hop transmitter 98 located in the drill bit 91. The MWD collar 96 can be adapted for several purposes. The MWD collar 96 can be adapted to analyze the data from the sensors in the drill bit 91 and make adjustments to the drilling parameters.

Alternatively, the MWD collar 96 can transmit the data to the surface via "mud-pulse telemetry," or by any other method known in the art. The MWD collar 96 can also be adapted to store the data measured by the sensors. One having skill in the art will realize that the MWD collar 96 can be adapted to perform any combination of these functions, and any other functions known in the art, without departing from the scope of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body adapted to be coupled to a drill string;

a sensor disposed in the bit body;

a single journal removably mounted to the bit body; and a roller cone rotatably mounted to the single journal.

2. The drill bit of claim 1, further comprising a short-hop telemetry transmission device adapted to transmit data from the sensor to a measurement-while-drilling device located above the drill bit on the drill string.

3. The drill bit of claim 1, wherein the sensor comprises a resistivity sensor.

4. The drill bit of claim 1, further comprising a box-end connection on an end of the bit body opposite from the removable journal and adapted to connect the drill bit to the drill string.

5. The drill bit of claim 4, wherein the sensor comprises a density logging sensor.

6. The drill bit of claim 4, wherein the sensor comprises a neutron logging sensor.

7. The drill bit of claim 4, wherein the drill bit is adapted to be paired with a rotary steerable system.

8. The drill bit of claim 4, wherein the drill bit is adapted to be paired with a drive device.

9. The drill bit of claim 1, further comprising a temperature sensor mounted in the single journal.

10. A bit body, comprising:

a box-end connection located on one end of the bit body and adapted to connect the bit body to a drill string;

a journal connection located at an opposite end from the box-end connection and adapted to receive a removably mounted journal; and a sensor mounted in the bit body.

11. The bit body of claim 10, wherein the sensor comprises a density logging sensor.

12. The bit body of claim 10, wherein the sensor comprises a neutron logging sensor.

13. A drill bit, comprising:

a bit body adapted to be coupled to a drill string;

a single journal removably mounted to the bit body;

a temperature sensor disposed in the single journal; and a roller cone rotatably mounted on the single journal.

14. The drill bit of claim 13, further comprising a sensor disposed in the bit body.

15. The drill bit of claim 14, wherein the sensor is a density logging sensor.

16. The drill bit of claim 14, wherein the sensor is a neutron logging sensor.

17. A drill bit, comprising:

a bit body;

at least one sensor disposed in the bit body;

a short-hop telemetry transmitter disposed in the bit body;

a box end connection adapted to connect the bit body to a rotary steerable system;

a single journal removably mounted to the bit body; and a roller cone rotatably mounted to the single journal.

18. The drill bit of claim 17, wherein the at least one sensor comprises a density logging sensor.

19. The drill bit of claim 17, wherein the at least on sensor comprises a neutron logging sensor.

* * * * *